US008201664B2

(12) United States Patent
Brouillet et al.

(10) Patent No.: US 8,201,664 B2
(45) Date of Patent: Jun. 19, 2012

(54) LUBRICATION SYSTEM AND METHOD, AND VORTEX FLOW SEPARATOR FOR USE THEREWITH

(75) Inventors: Sylvain Brouillet, St-Basile-le-Grand (CA); Pierre-Yves Légaré, Chambly (CA)

(73) Assignee: Pratt & Whitney Canada Corp., Longueuil (CA)

( * ) Notice: Subject to any disclaimer, the term of this patent is extended or adjusted under 35 U.S.C. 154(b) by 664 days.

(21) Appl. No.: 12/018,376

(22) Filed: Jan. 23, 2008

(65) Prior Publication Data

US 2009/0183950 A1 Jul. 23, 2009

(51) Int. Cl.
*F01M 1/10* (2006.01)
*B04C 5/02* (2006.01)

(52) U.S. Cl. ..... 184/6.24; 210/512.1

(58) Field of Classification Search ..... 184/6.23, 184/6.24, 6.11; 210/512.1, 787, 789
See application file for complete search history.

(56) References Cited

U.S. PATENT DOCUMENTS

| | | | | |
|---|---|---|---|---|
| 2,725,956 | A | 12/1955 | Cunningham | |
| 2,983,331 | A | 5/1961 | Helsley, Jr. | |
| 3,722,624 | A * | 3/1973 | Buckland | 184/6.11 |
| 4,093,428 | A | 6/1978 | Swogger | |
| 4,282,016 | A * | 8/1981 | Tauber et al. | 96/212 |
| 4,511,016 | A | 4/1985 | Doell | |
| 4,531,358 | A | 7/1985 | Smith | |
| 4,714,139 | A | 12/1987 | Lorenz et al. | |
| 4,793,440 | A | 12/1988 | Iseman | |
| 4,891,934 | A * | 1/1990 | Huelster | 60/39.08 |
| 4,947,963 | A | 8/1990 | Aho, Jr. | |
| 4,962,829 | A | 10/1990 | Sugden | |
| 5,028,318 | A * | 7/1991 | Aslin | 210/85 |
| 5,085,677 | A | 2/1992 | Ville et al. | |
| 5,218,832 | A | 6/1993 | Woolley | |
| 5,587,068 | A * | 12/1996 | Aho et al. | 96/210 |
| 6,463,819 | B1 | 10/2002 | Rago | |
| 6,470,666 | B1 | 10/2002 | Przytulski et al. | |
| 7,174,997 | B2 | 2/2007 | Sheridan | |
| 2006/0283788 | A1 * | 12/2006 | Schreppel | 210/96.1 |

* cited by examiner

*Primary Examiner* — Michael Mansen
*Assistant Examiner* — Robert Reese
(74) *Attorney, Agent, or Firm* — Norton Rose Canada LLP

(57) ABSTRACT

An aircraft engine lubrication system has a vortex separator, a first pump line having a first pump, an inlet connected to a separated lubricant area at the outlet end of the separator, and an outlet connectable to the engine. A scavenge line is provided for returning lubricant from the engine to an inlet end of the separator. A lubricant tank is connected in fluid flow communication with the separator by a connection line. A second pump line having a second pump has an inlet connected to the lubricant tank and an outlet connected to the separator for pumping lubricant from the tank to the inlet end of the separator.

19 Claims, 2 Drawing Sheets

LUBRICATION SYSTEM AND METHOD, AND VORTEX FLOW SEPARATOR FOR USE THEREWITH

TECHNICAL FIELD

The invention relates generally to lubrication systems and methods used to convey lubricant to and from lubricated components of an engine and, more particularly, to an improved system and method for lubricating components of an aircraft engine.

BACKGROUND OF THE ART

It is known to use vortex flow separator in aircraft engines. Such systems have the advantage of being substantially unaffected by changes in the gravity force caused by knife-edge or inverted flight, for example. The vortex flow separator is typically positioned inside the oil tank, and make-up oil can make its way from the oil tank to the separator through a plurality of make-up lines, and be entrained into the main circuit by the kinetic energy of the flow of scavenge oil. One drawback of such a system is that the supply of make-up oil can be disturbed when there are pressure variations in the scavenge oil pump line, for instance.

Although previously known separators and oil systems were satisfactory to a certain degree, there remains room for improvements. For example, some aircraft designs are not well suited to receive a separator inside the oil tank, and it can be desired to position the separator elsewhere. Furthermore, chips, foreign particles, or debris can be a sign of engine wear, and their recirculation to the engine is typically undesirable. Known separators were not appropriately designed to collect and/or detect them.

Accordingly, there is a need to provide an improved vortex flow oil separator and/or oil system.

SUMMARY

In one aspect, there is provided an aircraft engine lubrication system comprising a vortex separator having a generally cylindrical inner chamber with an inlet end and an outlet end, and a vent port; a first pump line having a first pump, an inlet connected to a separated lubricant area at the outlet end of the separator for receiving separated lubricant therefrom, and an outlet connectable to the engine; a scavenge line having an inlet connectable to the engine, and an outlet connected to the inlet end of the separator; a lubricant tank connected in fluid flow communication with the separator by a connection line; and a second pump line having a second pump, an inlet connected to the lubricant tank and an outlet connected to the separator, wherein, in use, a vortex is maintained in the separator, separated lubricant is pumped from the separator to the engine via the first pump line, lubricant is returned to the separator, mixed with gas, by the scavenge line, separated gas is evacuated from the vent port, and lubricant can be supplied to the separator from the lubricant tank by the second pump line.

In a second aspect, there is provided a method of providing lubricant to and from an engine with a lubrication system having a separator with an inlet end and an outlet end, and a gas tank, the method comprising:

- pumping scavenge lubricant from the engine to the inlet end of the separator;
- maintaining a vortex in the separator, the vortex having a separated oil area and a separated gas area;
- pumping lubricant from the outlet end of the separator, at the separated oil area, to the engine;
- venting gas from the separated gas area;
- pumping lubricant from the oil tank to the inlet end of the separator independently from the scavenge lubricant pumping; and
- chanelling excess lubricant from the separator to the oil tank.

In a third aspect, there is provided a vortex flow lubricant separator for use in an aircraft lubrication system, the separator comprising: a housing having a generally cylindrical vortex chamber with an inlet end and an outlet end, and configured and adapted to have a vortex of lubricant therein with a separated oil area and a separated gas area during use, a vent associated with the separated gas area, at least one tangentially oriented lubricant inlet at the inlet end, a lubricant outlet at the outlet end, and a circumferential debris-collecting groove located axially between the lubricant outlet and the inlet end in the vortex chamber.

Further details of these and other aspects of the present invention will be apparent from the detailed description and figures included below.

DESCRIPTION OF THE DRAWINGS

Reference is now made to the accompanying figures depicting aspects of the present invention, in which.

DETAILED DESCRIPTION OF THE PREFERRED EMBODIMENTS

Figure 1:
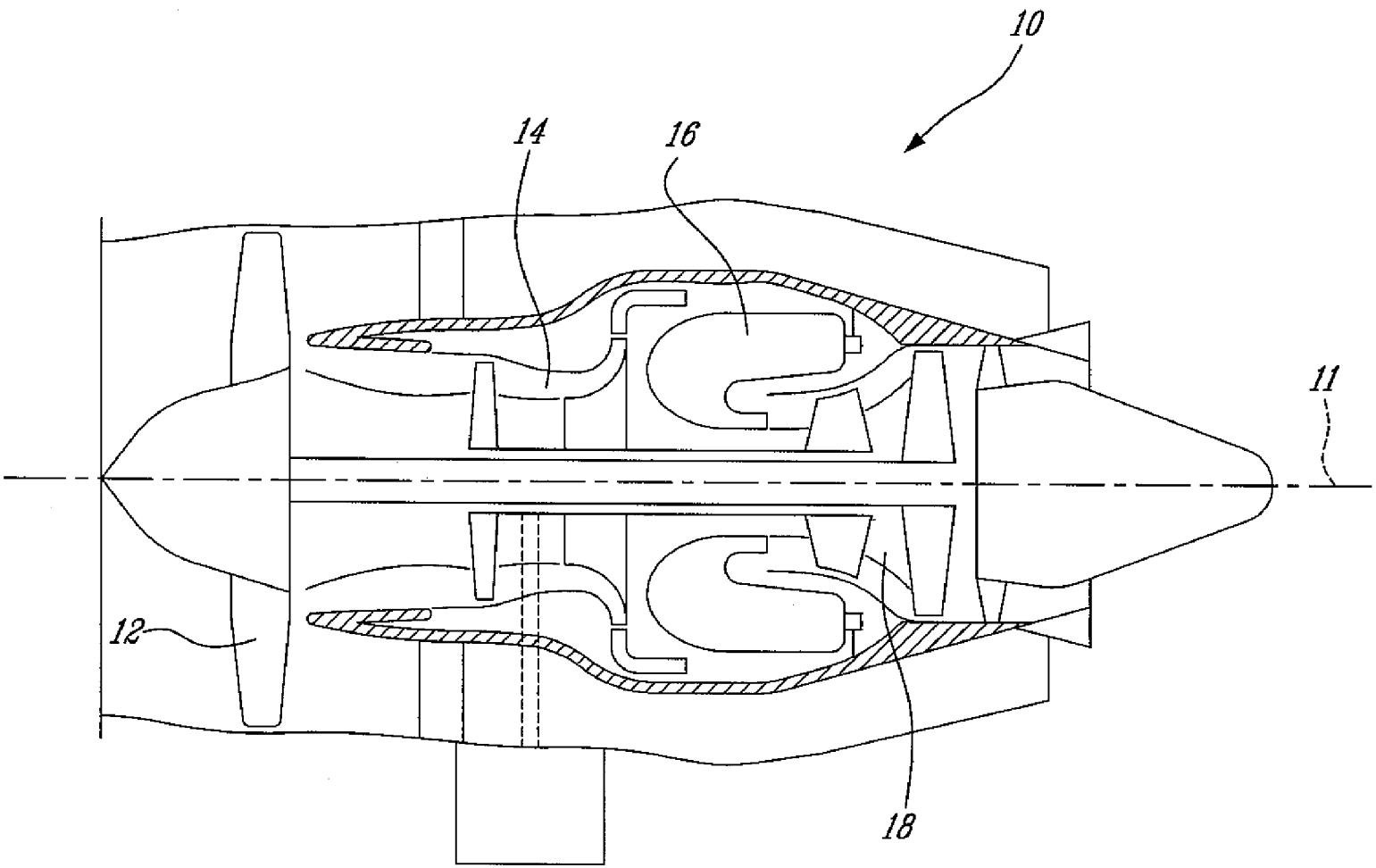
FIG. 1 is a schematic cross-sectional view of a gas turbine engine.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Several components of the gas turbine engine 10 require lubrication, such as bearings for the turbine section 18 and the multistage compressor 14, for instance.

Figure 2:
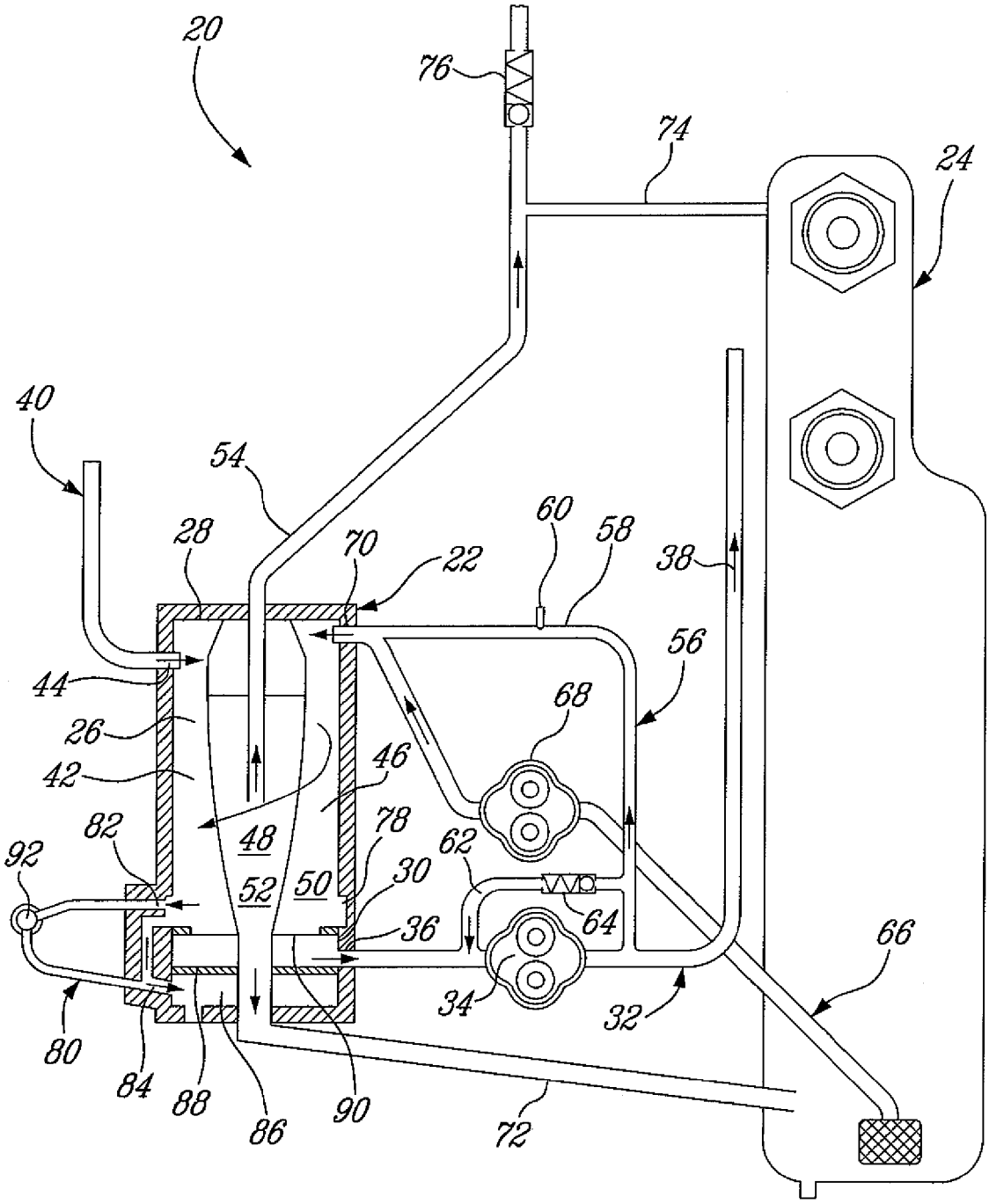
FIG. 2 is a schematic view of an example of an improved lubrication system.

FIG. 2 illustrates an example of an oil system 20 that can be used to convey oil to and from the engine 10. The oil system 20 generally includes a vortex flow separator 22, and an oil reserve, or tank 24. The separator 22 has a generally cylindrical vortex chamber 26 having an inlet end 28 and an outlet end 30. A first pump line 32 having a first pump 34 is provided to pump oil, from a first pump line inlet 36 provided at the outlet end 30 of the separator 22, to the engine 38, and a scavenge pump line 40 is used to pump scavenge oil mixed with air from the engine to the inlet end 28 of the separator. During use, a vortex of oil 42 is maintained in the separator 22 partly by the tangential component of the kinetic energy of the scavenge oil 44 which is tangentially supplied into the inlet end 28 of the vortex chamber 26. The oil spirals along the generally cylindrical vortex chamber 26, from the inlet end 28 to the outlet end 30, and is separated into a separated oil component 46 and a separated gas component 48 due to centrifugal force, and the differing densities of the oil and the gas. The separated oil 46 can be said to occupy, during use, an area of the vortex chamber 26 referred to herein as the separated oil area 50, whereas the air migrates toward the center of the chamber in an area referred to as the separated gas area 52. Typically, there is a region in the vortex 42 between the separated oil 46 and the separated gas 48 which contains mixed oil and gas. The shape of the vortex 42 is affected by gravity but usually remain substantially conical or cylindrical. A vent 54 is provided in the separated gas area 52 to evacuate the separated gas 48.

In this example, the system also includes a vortex supply line 56 having a conduit 58 branching off from the first pump line 32, downstream of the first pump 34, and equipped with a pressure activated valve or an adjustable orifice 60 which allows to divert a predetermined percentage of oil pumped with the first pump 34, directly back to the inlet end 28 of the separator 22, without going through the engine. The inlet 36 of the first pump line 32 is positioned in a separated oil area 50 at the outlet end 30 of the separator, and thus receives separated oil 46 which has a greater density than the mixed oil and air provided by the scavenge pump line 40. The greater density can yield greater kinetic energy. Returning a portion of the flow of separated oil back to the inlet end 28 of the separator 22, in a tangential manner, can thus be an efficient way of contributing to maintain the vortex 42 in the separator 22. In this example, the vortex supply line 56 can thus be said to include the first pump 34 and a portion of the first pump line 32. Alternately, the vortex supply line can be independent from the first pump line, or entirely omitted, for example.

In this case, the first pump line 32 has a recirculation conduit 62, having a cold-start pressure valve 64 adapted to yield when an excessive amount of pressure is present therein, such as can occur during cold-temperature startoff, for example. The recirculation conduit 62 allows to pump oil directly between the outlet and the inlet of the first pump until the oil warms up sufficiently to flow substantially freely through the engine. Alternately, the recirculation conduit can be provided between the inlet end and the outlet end of the separator with a combined valve, for example.

Typically, it is normal for engines to consume, or lose, a given flow rate of oil during operation. Also during transient operation the amount of oil retained in the engine can vary. So-called make-up oil can be used to compensate for the consumption of oil by the engine and the transient demand. In the case of some engines, it is possible to measure or calculate, within certain tolerances, how much oil the engine is susceptible to consume, at different stages of its lifespan, and how much the retained oil volume can vary during transient and thus obtain a predetermined approximation of a required flow rate of make-up oil to compensate for these factors.

In this example, a second pump line 66, having a second pump 68 which can have a pumping flow rate selected specifically for the predetermined rate of oil consumption, is used to pump make-up oil from the oil tank 24 to an outlet 70 in the separator. The outlet 70 is tangentially positioned in the inlet end 28 of the separator 22 for the kinetic energy of the make-up oil to contribute in maintaining the vortex. In this example, the second pump line 66 and the vortex supply line 56 share the same outlet, but they can have respective outlets in alternate embodiments, for example.

A connection line 72 connects the separator 22 to the oil tank 24. The connection line 72 provides fluid flow communication between the separator 22 and the oil tank 24.

In use, the amount of oil in the vortex 42 is kept in equilibrium by the pressure therein, the kinetic energy maintaining the vortex, and its evacuation to the oil tank 24. Excess oil is pushed out from the separator 22, back to the tank 24, via the connection line 72. The connection line can be provided substantially axially through the outlet end 30 of the separator 22 so as to allow mixed oil and air to be evacuated to the oil tank 24. The oil and air separate over time, and the oil tank 24 has a tank vent 74, with an orifice, to allow evacuation of the air therefrom. Henceforth, even if the amount of make-up oil pumped into the separator 22 is greater than the amount of oil consumed by the engine, the excess oil is simply evacuated back to the oil tank 24 via the connection line 72. The flow rate of the second pump 68 can thus be selected to correspond to a worst-case scenario of engine demand, for example.

In this example, the separator vent 54 and oil tank vent 74 are connected to an auxiliary gearbox system of the aircraft (not shown), via a pressure valve, including a by-pass orifice, 76. Both the first pump 34 and the second pump 68 are operated by a rotating shaft connected to the engine.

Henceforth, in use, mixed oil and air is pumped to the inlet end 28 of the separator 22, and the kinetic energy thereof contributes to maintain the vortex 42. Separated oil 46 is continuously pumped from the outlet end 30 of the separator 22, and fed to the engine. A portion of this pumped separated oil is returned to the inlet end 28 of the separator 22 to feed the vortex 42. The second pump line 66 continuously adds oil in the separator 22 to compensate for oil consumption. Excess oil in the separator 22 is channelled back to the oil tank 24 via the connection line 72.

During startoff of the engine, the vortex is not yet set up. It can thus be advantageous that the size and relative position of the oil tank and the separator be configured in a manner that the level of oil in the separator is naturally maintained sufficient for there to be oil at the inlet of the first pump line within a predetermined startoff attitude envelope of the aircraft. The startoff attitude envelope of the aircraft can be of 5° from any horizontal direction, for example. The separator and the oil tank communicate via the connection line, and so if the amount of oil is insufficient in the separator, the level of oil in the oil tank can reach equilibrium with the level of oil in the separator by oil moving therebetween via the connection line. Hence, the minimum oil level in the oil tank should be above the inlet to the first pump line in the separator, at any aircraft attitude within the predetermined attitude envelope.

In this example, the separator 22 has a circumferential groove 78 at the outlet end 30 thereof between the inlet 36 of the first pump line 32 and the inlet end 28. Debris, such as metal chips, for example, which are heavier than the lubricant, tend to slide against the cylindrical wall of the vortex chamber 26. During use of the separator, they eventually become trapped within the circumferential groove 78. In this example, a lubricant passage 80 has an inlet 82 in the circumferential groove 78, to receive debris. The lubricant passage 80 has an outlet 84 in a debris-collecting chamber 86 at the outlet end 30 of the separator 22, after the circumferential groove 78 and the inlet 36 of the first pump line 32. The debris-collecting chamber 86 is partitioned from the vortex chamber 26 by a screen 88, or other filter element, which can prevents chips greater than a predetermined mesh dimension from traveling back into the vortex chamber 26, and into the first pump line 32. This chamber captures the debris and provides a sampling access (drain port) for analysis to determine the source. A screen 90 is also used between the circumferential groove 78 and the inlet 36 to the first pump line 32, for example. This can contribute to protect the lubricated engine components from damage or premature wear caused by large debris.

Additionally, a chip detector 92 can be provided in the lubricant passage 80 to provide a signal when a chip or other debris is detected. This can help detect unusual operation performances of the engine, for example.

The lubricant passage 80 can be arranged for oil to be channelled therethrough without the use of a pump, such as by a suitable orientation or position of the inlet and outlet which provides a pressure differential therebetween, such as a difference between dynamic pressure at the inlet 82 and dynamic pressure at the outlet 84, for example.

The system can be used with any suitable type of engine. In the case of a turbofan engine, for example, the system can be pressurized, whereas in the case of a propeller engine, for example, the system can be unpressurized. Any suitable viscous lubricant can be used in the system.

The above description is meant to be exemplary only, and one skilled in the art will recognize that changes may be made to the embodiments described without departing from the scope of the invention disclosed. For example, the separator can be provided inside the oil tank in an alternate embodiment. Still other modifications which fall within the scope of the present invention will be apparent to those skilled in the art, in light of a review of this disclosure, and such modifications are intended to fall within the appended claims.

What is claimed is:

1. An aircraft engine lubrication system comprising a vortex separator having a generally cylindrical inner chamber with an inlet end and an outlet end, and a vent port; a first pump line having a first pump, an inlet connected to a separated lubricant area at the outlet end of the separator for receiving separated lubricant therefrom, and an outlet connectable to the engine; a scavenge line having an inlet connectable to the engine, and an outlet connected to the inlet end of the separator for directing a gas/lubricant mixture into the separator; a lubricant tank connected in fluid flow communication with the separator by a connection line; and a second pump line having a second pump, an inlet connected to the lubricant tank and an outlet connected to the separator, the second pump providing a dedicated oil supply to the separator by pumping make-up oil from the lubricant tank to the separator independently of the gas/lubricant mixture supplied to the vortex separator, the dedicated oil supply pumped by the second pump maintaining a vortex of oil in the separator irrespectively of the gas/lubricant mixture fed into the separator by the scavenge line, wherein, in use, a vortex is maintained in the separator, separated lubricant is pumped from the separator to the engine via the first pump line, lubricant is returned to the separator, mixed with gas, by the scavenge line, separated gas is evacuated from the vent port, lubricant is supplied to the separator from the lubricant tank by the second pump line, and excess oil in the separator is returned back to the lubricant tank via the connection line.

2. The lubrication system as defined in claim 1 wherein the separator is provided separately from the lubricant tank.

3. The lubrication system as defined in claim 1 wherein the second pump line is independent from the scavenge line.

4. The lubrication system as defined in claim 1, further comprising a vortex supply line having an inlet connected to a separated lubricant area at the outlet end of the separator for receiving separated lubricant therefrom, an outlet oriented tangentially in the inlet end of the separator, and a vortex supply pump for pumping separated lubricant from the inlet to the outlet and feeding the vortex during use of the system.

5. The lubrication system as defined in claim 4, wherein the vortex supply pump is the first pump, and the vortex supply line has a conduit forking from the first pump line, after the first pump, and connecting the outlet of the vortex supply line.

6. The lubrication system as defined in claim 5 wherein the vortex supply line is configured and adapted to divert a portion of the lubricant outputted from the first pump to the conduit during use of the lubrication system.

7. The lubrication system as defined in claim 4 wherein the vortex supply line is independent from the scavenge line.

8. The lubrication system as defined in claim 4 wherein the outlet of the vortex supply line is the outlet of the second pump line.

9. The lubrication system as defined in claim 1 wherein the second pump is configured and adapted for pumping a predetermined flow rate of lubricant required by the engine operation.

10. The lubrication system as defined in claim 1 wherein the outlet of the scavenge line is tangentially oriented in the generally cylindrical inner chamber of the separator.

11. The lubrication system as defined in claim 1 wherein the outlet of the second pump line is tangentially oriented in the generally cylindrical inner chamber of the separator.

12. The lubrication system as defined in claim 1 wherein the connecting line is connected to the separator in a manner to receive partially separated lubricant therefrom during use of the system.

13. The lubrication system as defined in claim 6 wherein the connecting line has an inlet positioned substantially axially through the outlet end of the separator.

14. The lubrication system as defined in claim 1 wherein the first pump line has a recirculation conduit configured and adapted to recirculate lubricant from an outlet of the first pump back to the inlet of the first pump when the pressure of the pumped lubricant exceeds a predetermined threshold.

15. The lubrication system as defined in claim 1 wherein the scavenge line has one or more pumps for scavenging lubricant from respective areas of the engine.

16. The lubrication system as defined in claim 1 wherein the lubricant is oil.

17. The lubrication system as defined in claim 1, wherein the shape, size, and relative position in the aircraft of the separator and gas tank are configured and adapted for lubricant to flow from the lubricant tank to the inlet of the first pump line under the effect of gravity when the attitude of the aircraft is within a predetermined startup attitude envelope.

18. A method of providing lubricant to and from an engine with a lubrication system having a separator with an inlet end and an outlet end, and a gas tank, the method comprising:

pumping scavenge lubricant from the engine to the inlet end of the separator;

maintaining a vortex in the separator, the vortex having a separated oil area and a separated gas area;

pumping lubricant from the outlet end of the separator, at the separated oil area, to the engine;

venting gas from the separated gas area;

pumping additional lubricant from the oil tank to the inlet end of the separator independently from the scavenge lubricant pumping, the additional lubricant contributing to maintaining the vortex in the separator irrespectively of the scavenge lubricant pumping; and channelling excess lubricant from the separator to the oil tank.

19. The method according to claim 18, comprising pumping lubricant from the outlet end of the separator, at the separated oil area, directly to the inlet end of the separator.

* * * * *